United States Patent [19]

Avison et al.

[11] 4,149,807

[45] Apr. 17, 1979

[54] METHOD OF TYPEWRITING OR PRINTING

[75] Inventors: Gerald Avison, Cambridge; Philip T. Blenkinsop, Royston; John D. Marsh, Royston; Dexter R. Plummer, Ongar, all of England

[73] Assignee: Facit Aktiebolag, Atvidaberg, Sweden

[21] Appl. No.: 773,302

[22] Filed: Mar. 1, 1977

[30] Foreign Application Priority Data

Mar. 4, 1976 [GB] United Kingdom ..... 8632/76

[51] Int. Cl.[2] ..... B41J 3/02

[52] U.S. Cl. ..... 400/118; 400/17; 400/126

[58] Field of Search ..... 197/1 R; 101/93.04, 101/93.05; 346/75, 140 R; 340/324 A; 400/17, 18, 118, 124, 126

[56] References Cited

U.S. PATENT DOCUMENTS

| | | | |
|---|---|---|---|
| 3,087,772 | 4/1963 | Ascoli | 346/140 R |
| 3,349,176 | 10/1967 | Ascoli | 197/1 R X |
| 3,691,551 | 9/1972 | Kashio | 340/324 A |
| 3,735,389 | 5/1973 | Tarczy-Hornoch | 340/324 A |
| 3,805,274 | 4/1974 | Kashio | 340/324 A X |
| 3,831,729 | 8/1974 | Woods et al. | 197/1 R |
| 3,842,955 | 10/1974 | Iwasaki | 197/1 R |
| 3,900,094 | 8/1975 | Larsen et al. | 197/1 R |
| 3,907,089 | 9/1975 | Montoya | 197/1 R |

FOREIGN PATENT DOCUMENTS

| | | | |
|---|---|---|---|
| 1447915 | 4/1969 | Fed. Rep. of Germany | 197/1 R |

*Primary Examiner*—Paul T. Sewell

*Attorney, Agent, or Firm*—Scrivener, Parker, Scrivener & Clarke

[57] ABSTRACT

A method of reproducing characters or symbols in place of orthodox typing or printing comprises applying ink to successive points on the paper or other surface by means of a transducer forming a typehead, and building up each character by steering the transducer under the control of digitally stored information which may be selected from the store by a keyboard. The characters can be built up as a series of overlapping dots and each character may have a number of key points, the transducer moving along one of a limited number of pre-set paths from each key point to the next.

2 Claims, 8 Drawing Figures

METHOD OF TYPEWRITING OR PRINTING

SPECIFIC DESCRIPTION

This invention relates to the reproduction of predetermined characters, symbols, devices and even pictures, by a typing or printing process. It is primarily concerned with reproduction by typing, that is to say, in which ink is transferred, by the impact of a moving typeface body, from a ribbon (or the equivalent) onto the paper or other surface, although, as will be seen from what follows, the invention may be extended to the application of ink directly from the moving body.

Conventional typewriters employ a type basket made up of bars carrying raised type on their free ends, and the whole of each symbol is reproduced simultaneously on the paper by the impact of this raised type on the intervening ribbon. The number of symbols available is limited by the number of type bars that can be fitted into the basket and it is usually limited to the basic letters (in lower and upper case) and digits, plus a few punctuation marks, about eighty eight symbols in all. To change the type face to a different style or to suit a different language is a complicated procedure. An advance in this respect is the so-called 'golf-ball' type head in which all the characters are carried in raised type on a single head, in a manner similar to the old cylindrical type head that preceded the basket. The type head is readily removable and can quickly be replaced by one bearing a different typeface or a different set of characters altogether. However this still requires a manual step on the part of the user and it can become tiresome and slow when repeated changes of the head are required in the course of a single passage of written work. Moreover there is even the problem of storing and identifying the heads when a large number of type heads is involved.

There is also the known 'dot-matrix' system in which individual needles or array of needles in a matrix pattern are selectively energised to strike the ribbon simultaneously or in sequence in predetermined areas to produce the required symbol as an array of dots. However the definition of this system is poor, even with a matrix having many rows and columns, and it cannot approach the clarity of normal typeface.

The chief aim of the present invention is to provide a new method of reproducing characters, symbols, and suchlike without significant restriction on the number of different characters or symbols that can be reproduced. According to the invention, in its broadest aspect, characters or symbols or the like are each built up sequentially on the paper or other surface by a stylus moved in two dimensions under the control of electrically stored information characteristic of the required character or symbol.

It is known nowadays that large amounts of information can be stored in very small spaced in electrical form, chiefly in digital form, and so the instructions for generating a very large number of characters or symbols can be stored wholly digitally in a typewriter or printing machine of practical dimensions. There could be a standard keyboard in conjunction with arrays of keys or buttons capable of calling up any one of a wide range of sets of typefaces, symbols or characters, in a way somewhat analogous to an array of organ stops that can call up different ranges and voices from a given organ keyboard.

In a preferred arrangement each character or symbol (called simply a character below, for convenience) is built up as an array of dots produced by vibrating the stylus in a direction perpendicular to the plane of the paper or other surface. As there will generally only be a single stylus and as the frequency of vibration is limited only by mechanical considerations and by the power input required to produce sufficient impact force at the required rate, there is not the same restriction on definition that there is in the known dot-matrix process; the dots can be very small and can overlap by as much as desired (commensurate with an adequate writing speed) so the definition can equal or exceed that of normal typeface.

Preferably each character is built up sequentially as a series of overlapping dots by moving the stylus along a combination of straight and curved paths starting from a datum point, or key point. Preferably there are several key points associated with each character and, starting from one key point, the stylus moves towards next key point along a path selected from one of a number of limited paths available, then on reaching that next point it receives fresh instructions for moving to the third key point and so on. For example there may be, from any given key point, thirty two available directions, and sixteen different radii of curvature.

Steering of the stylus may be by polar or cartesian co-ordinates; in the example described below the latter are used.

It will be appreciated that the invention is not limited to the reproduction of lettering and numerals but can be employed to reproduce patterns, diagrams and even simple pictures. The definition of the characters built up will be related to the speed of writing. For example, for some purposes one may prefer a poor definition but high writing speed; for others a high quality is preferred, but the writing takes longer. The fact that all the information for controlling the speed and manner of movement of the stylus is stored electrically allows complete flexibility on this point, and the same machine can be used for low-speed high-definition or high-speed low-definition work.

The printing head that carries the stylus may be mounted in a fixed position whilst the paper or other surface on which the reproduction is to be performed is moved in relation to it in two dimensions, as in a conventional typewritter carriage. Alternatively the printing head may be indexed with respect to the paper in at least one dimension as in a known 'golf-ball' typewriter. However a further possibility is for the printing head to be entirely mobile, connected to its information store and input only by the required flexible electric leads. This opens up the possibility of using it to apply lettering or symbols to large drawings or architect's plans, as an alternative to existing transfer methods.

The invention will be further described by way of example with reference to the accompanying drawings, in which.

Figure 1:
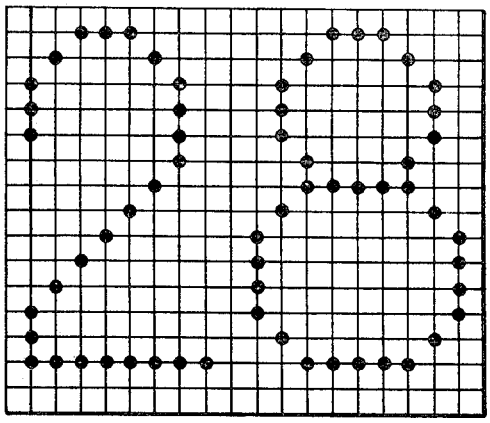
FIGS. 1 and 2 are diagrams illustrating two possible basic principles on which the invention can be put into practice.

We refer first to FIG. 1. For convenience we will describe the invention with reference to the typing of ordinary digits and letters although, as indicated earlier, it can be used to reproduce any shape that is capable of being built up sequentially by lines, its complexity being limited only by the capacity of the information store and the time available for building it up. FIG. 1 shows two digit symbols built up as a pattern of dots, each dot lying in one of a limited number of predetermined positions in a matrix, in a manner similar to that of the known dot-matrix system except that, instead of each dot being produced by a separate needle, the symbol is built up sequentially by a single needle or stylus moving from point to point under the control of a steering system fed with information characteristic of the required symbol from a digital data store. In FIG. 1 the matrix is a coarse one, 9 by 15, giving a total of 135 possible positions for the dots and in a typical symbol there are between thirty and forty dots. Each available dot position is uniquely identifiable in Cartesian co-ordinates from datum lines, for example from the bottom line and left hand line, and this position can be stored as two digits. Thus, when, for example, a typewriter key is pressed to call for the printing of the symbol '2,' the required information is fed in sequence from a store to a transducer, causing that transducer to reproduce a dot at the start of the symbol, then to move to the next position and reproduce a further dot, and so on, building up the symbol as the required number of dots. On completion of the symbol the transducer will wait, preferably after returning to a rest position which may be the bottom left-hand corner of the matrix, until it receives instructions for the reproduction of the next symbol, which is the numeral '8' in the example shown. The necessary displacement to the area where the next symbol is to be printed can be by movement of the transducer or of the surface on which the printing is being done, just as in known typewriters. Of course it is not necessary for the reproduction of the successive symbols to bear a 'real time' relationship to the keying-in. The information on the symbols to be reproduced can be stored and fed later to the transducer as fast as it is capable of operating, just as in known word-processing equipment.

The description above is of an elementary form of the invention. However it will be apparent straightaway that, unlike the known dot-matrix system which is limited to a resolution of about 5×7 or, at most, 9×16 by the mechanical restrictions of the large number of needles to be packed into the space, the system according to the invention can have a matrix of a resolution as high as desired. The only limitation is on the capacity of the store to hold the more detailed information, and on the ability of the transducer to follow the small steps involved.

Thus although the coarse matrix of FIG. 1 involves substantial distortion from the desired form of the symbols reproduced, it is possible, by increasing the resolution, to attain the same accuracy of form as in typeface produced by raised type or by printing.

Moreover, in the simple example shown in FIG. 1 the dots are spaced apart. However, with an increase in resolution the dots will be so close together that they overlap and in practice we find that continuous lines having edges as smooth as those obtained in normal typeface are obtainable if the spacing between the centres of successive dots is less than 1.2 times the radius of the dot, and preferably we make it equal to the radius or to 0.9 of the radius. A drawback of the rectilinear matrix system used in FIG. 1 is that, even with a high resolution matrix, the overlap between successive dots will vary as between lines parallel to the datum lines on the one hand and inclined lines on the other hand.

Figure 2:
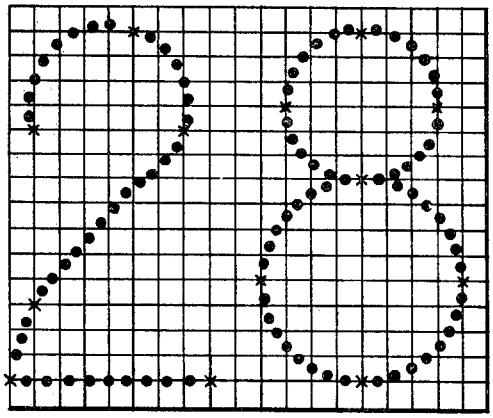

FIG. 2 illustrates the principle of an alternative (and preferred) way of building up the symbols. Here the matrix is a relatively coarse one, (9×15 in the example shown) but is only used to locate certain points (which we call 'key points') in the symbols. Movement between these points is along straight lines and smooth curves unrelated to the matrix. The key points are shown in FIG. 2 by crosses. Thus, to build up the symbol '2', the stylus is first brought to the starting key point at the left-hand side and then instructed, by the stored information, to move upwards in a pre-determined starting direction but along a path with a right-hand curvature of predetermined radius. Then when it reaches the next key point, lying at one of the matrix points at the top of the Figure, it receives fresh instructions to carry on in a curve of the same radius to the third key point, where it is instructed to proceed in a straight line of predetermined inclination to the fourth point, and so on.

Therefore in this version of the system the information stored for producing symbols of high definition, instead of comprising a very large number of matrix points (as would be required by the FIG. 1 system) comprises a small number of matrix points together with a small number of instructions to proceed in a number of specified paths of specified curvatures.

For example, for a given quality of reproduction of lettering comparable with ordinary typeface, it may be necessary to store thirty two directions (i.e. inclinations $11\frac{1}{4}°$ apart) together with sixteen different radii of curvature. A complete symbol of a simple nature may, in a typical example, be characterised by half a dozen matrix points with a corresponding number of directions and radii.

Figure 3:
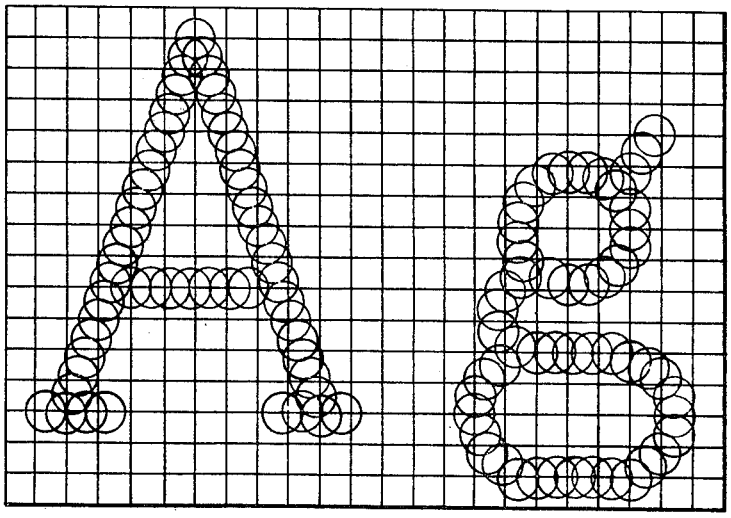
FIGS. 3 and 4 are similar diagrams illustrating the principles in more detail.
Figure 4:
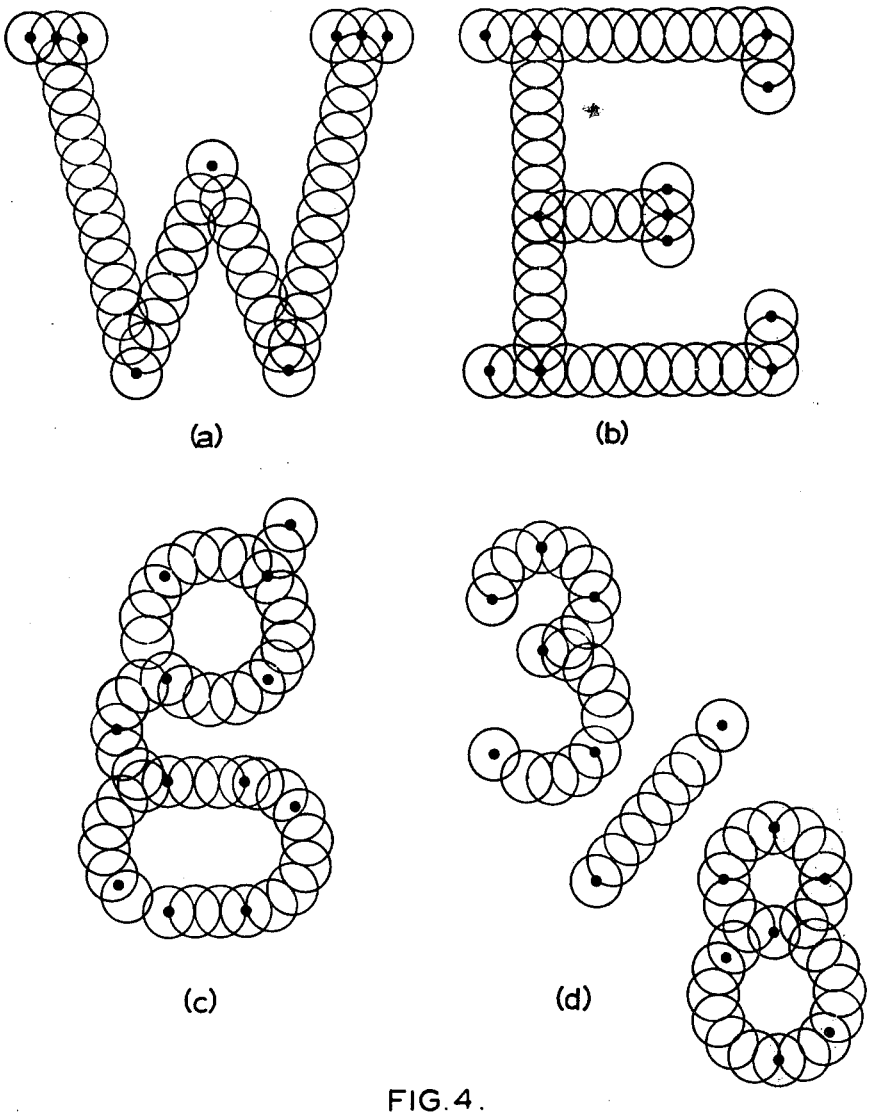

FIG. 3 illustrates two practical examples of letters built up by the method of FIG. 1 but using a 64×96 matrix. The diameter of the dots is about five times the pitch of the matrix. As will be seen from the right-hand symbol, with this degree of resolution a good approximation to smooth lines is obtainable, and the left-hand symbol shows that serifs can be incorporated. FIG. 4 shows several examples of symbols built up by the method of FIG. 2 using a medium-resolution matrix of 16×24. It is worth mentioning that, as shown in the bottom right-hand symbol, it is not necessary for the symbol to be built up by a continuous line; on the contrary, the instructions can include orders to halt the production of dots during parts of the movement. Indeed, this will be true also of joined up symbols like the top right-hand one, and there are few symbols that can be built up by a single continuous line.

The formation of the dots is achieved by reciprocating a stylus in a direction perpendicular to the plane of the paper or other surface. The stylus has a blunt end, equal in diameter to the required dot, and it strikes a ribbon to transfer ink to the paper as in normal typing. The amplitude of movement must be sufficient to allow transverse movement of the stylus between successive dots and the force must be sufficient to produce a satisfactory transfer of ink. These two factors put an upper limit on the frequency of dot formation and hence, for a given resolution, on the writing speed. The reader will readily be able to work out the relationship between the various factors, but some typical figures may be helpful. In one example, the diameter of the tip of the stylus (and therefore of the dots) is 0.2 mm and the spacing between the centres of successive dots is 0.09 mm. The stylus is vibrated at a frequency of 1.2 KHz with an amplitude of 0.4 mm peak-to-peak.

If we consider symbols built up within a matrix 3 mm square and assume an average of sixty dots to make up each symbol this gives a printing rate of about 16 symbols per second, allowing for 20% of the time being spent in dwells between symbols.

The steering rate, i.e. the response of the transducer in each of two orthogonal directions parallel to the plane of the paper, needs to be of the order of 100 Hz. It is possible, as will be seen below, to construct a mechanism with this kind of response.

Thus the system according to the invention can reproduce symbols of a quality and size equal to those of existing type face at a rate of the order of sixteen characters per second, very much the same as a 'golf-ball' typewriter. As explained earlier, however, the choice of symbols under the direct control of the operator is very much greater and requires mere selection by keys, no changing of type heads.

Figure 5:
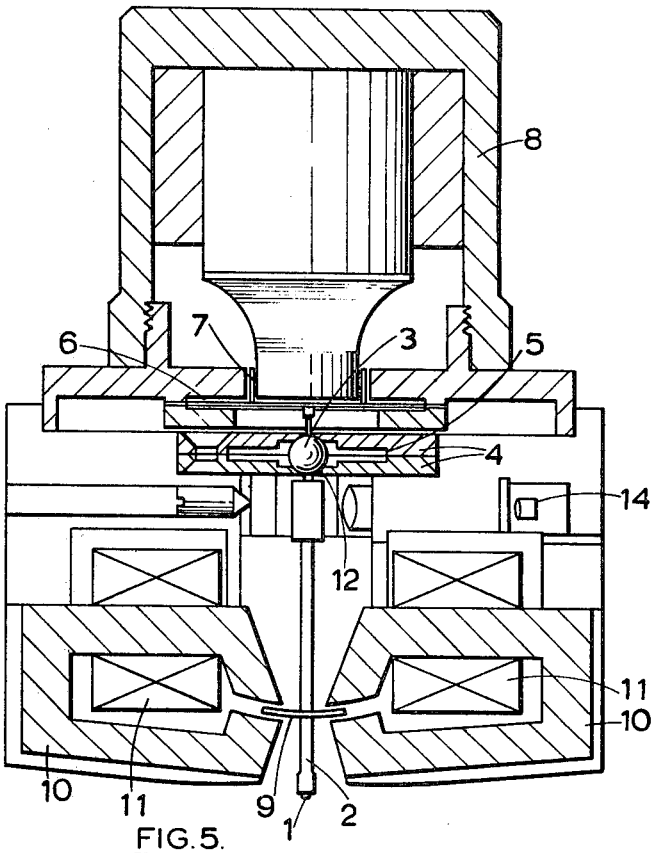
FIG. 5 is a vertical sectional elevation through one form of transducer for putting the invention into practice.
Figure 6:
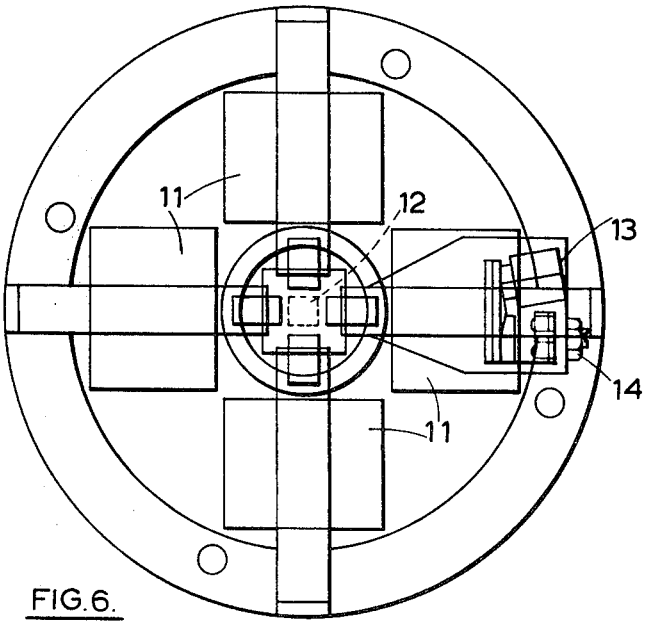
FIG. 6 is a view of the transducer of FIG. 5, looking from below.

FIGS. 5 and 6 show a practical form of the transducer. The needle or stylus 1 which produces the dots is guided in a jewel bearing (not shown) in the lower end of a tube 2. The upper end of the tube 2 is mounted in a ball 3 located in angled bearing pads 4 and is constrained against rotation by being fixed at the centre of a diaphragm 5. Thus the tube 2 is free to rock in two orthogonal planes normal to the axis of the tube but is prevented from rotating about its axis and from translatory movement in all three directions. The upper end of the needle 1, which extends up the centre of the tube 2, projects beyond the ball 3 and is attached to the centre of a diaphragm 6 carrying an electrical coil 7 in the annular air gap of a pot-shaped permanent magnet 8, the structure being very like that of a moving coil loudspeaker. A suitable drive circuit feeds an electrical signal to the coil 7 to cause the coil and needle assembly to oscillate axially at its resonant frequency to produce the required succession of dots. Typically this frequency will be of the order of 1200 Hz.

Near the free end of the tube 2 is fixed a square soft iron plate 9 which, in its neutral position, lies symmetrically in the air gaps of four electromagnets 10 of which the C-shaped iron cores are spaced symmetrically around the axis of the needle.

The four iron circuits are supplied with biassing fields of similar strength and polarity. It will be appreciated that these fields may be generated by means of a DC supplied electromagnet or alternatively a permanent magnet, inserted in the iron circuit. In the case of a permanent magnet bias it is necessary to use a material which is resistant to demagnetisation, for example Samarium Cobalt.

The application of opposing signals to the coils 11 of one opposing pair of electromagnets will deflect the needle 1 along a line perpendicular to its axis and in the plane of that pair of electromagnets. With this configuration the magnitude of the force will be a function of the exciting current and independent of the position of the soft iron plate. The application of opposing signals to the coils of the other pair will deflect the needle along a second line, orthogonal to the first and to the axis. Thus the appropriate feeding of signals to these coils can control the position of the tip of the tube 2, and hence of the needle 1, to any point within a given area, for example a 3 mm square. The deflection is against the restoring force of the diaphragm 6.

With the control system to be described below, and using the key point principle described with reference to FIG. 2, it is necessary to feed back to the control system information on the position of the needle 1. For this purpose the tube 2 carries a four-sided mirror 12, only two faces of which are used. A light shone onto one of its faces from a source 13 (FIG. 6) is reflected back and picked up by a pair of detectors 14.

Figure 7:
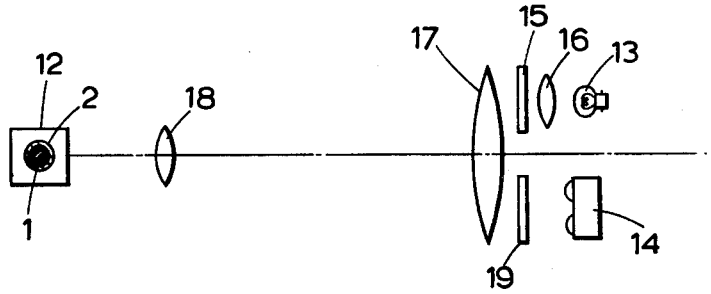
FIG. 7 illustrates diagrammatically in more detail the optical feedback system used in the transducer of FIGS. 5 and 6.

Referring now to FIG. 7, the source 13 is in the form of a lamp, the light from which uniformly illuminates a grating 15 through a condenser lens 16. A lens 17 focusses an image of the grid onto an objective lens 18 and after reflection from the mirror 12 an image of the grating 15 is superimposed on a second grating 19, the grid lines of which are suitably inclined at a small angle to those of the image of the grating 15. The resulting moire fringes are detected by a pair of spaced detectors 14, which are arranged to derive phase information so that the direction of motion of the fringes can be ascertained electronically.

Tilting of the mirror 12 attached to the tube 2 causes translation of the fringes and counting of the fringes traversing the detectors 14 gives a direct measurement of the angle traversed by the mirror and hence of the distance moved by the needle 1.

This measuring system has the advantage that it is insensitive to lateral translation of the mirror or to small movements of the mirror unaccompanied by vertical tilting. Hence it only responds to tilting of the mirror in the required plane.

It will be understood that a second optical system identical with that shown in FIG. 7 detects movement of the needle in the orthogonal plane, using a second face of the mirror 12.

Another way of providing a position feedback signal would be to superimpose a high frequency signal on the current feed to the coils 11 and to derive information on the position of the plate 9 from the reluctance offered to the high frequency signal by the magnetic circuit of the electromagnet 10. This would eliminate the need for the optical system shown in FIG. 7 but it has its problems in practice.

Figure 8:
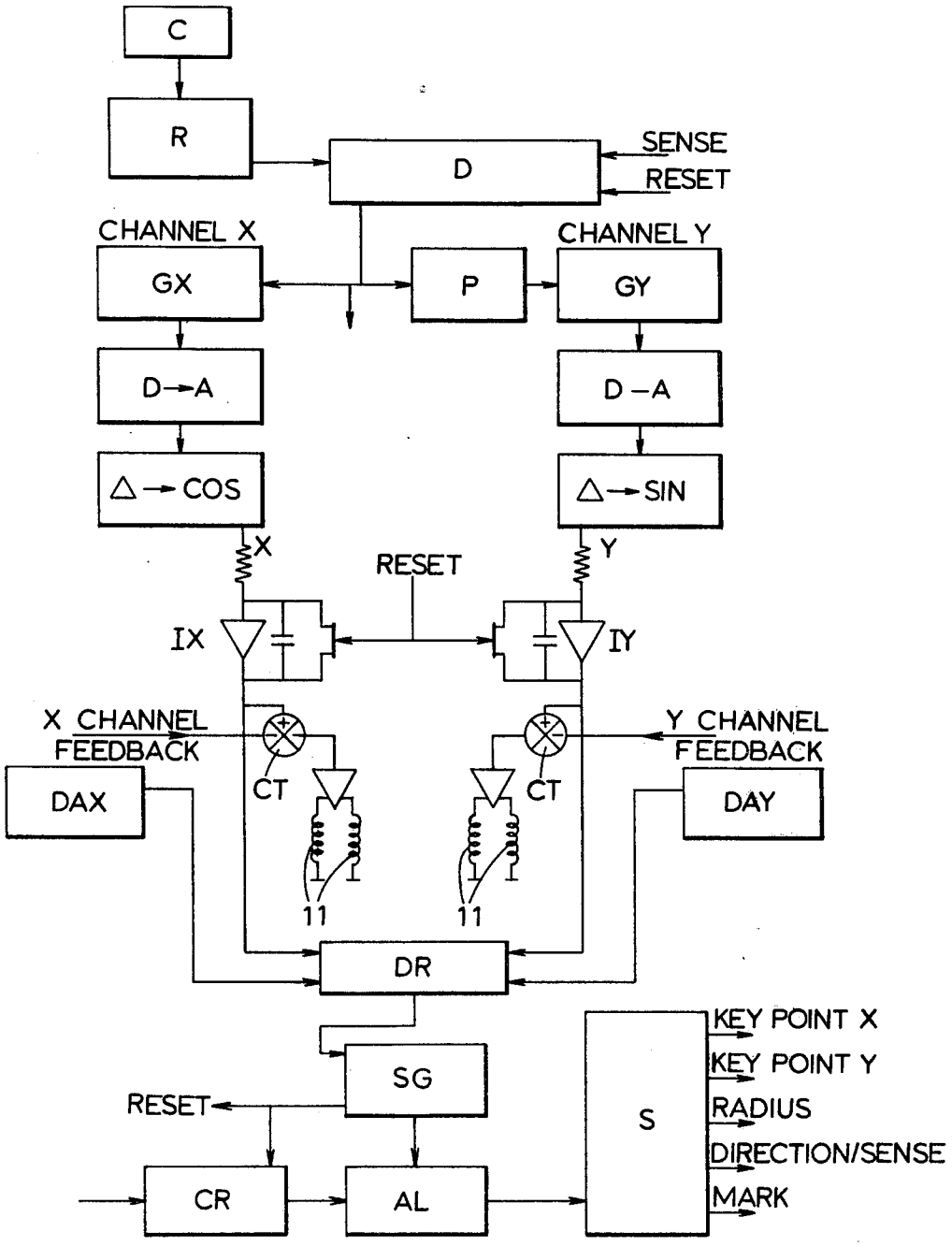
FIG. 8 is a block circuit diagram of a steering system for the transducer of FIGS. 5, 6 and 7.

A control circuit suitable for driving the transducer of FIGS. 5 and 6 is shown in outline in FIG. 8. A clock signal generator C provides the pulses from which are derived the radius information R in the form of a four-bit signal, giving sixteen choices of radius (including an infinite radius or straight line). A direction counter D makes available 32 different directions, spaced $11\frac{1}{4}°$ apart around the compass. These examples, selected in a manner to be described below, are effectively polar co-ordinate signals used to drive the needle in two orthogonal directions, X and Y in Cartesian co-ordinates. For this purpose each channel, X and Y, has a digital triangle generator GX and GY, the signal from which is converted to analogue form and used to generate a sine signal (X) and a cosine signal (Y) that is integrated at IX or IY respectively and fed to a respective comparator CT. The necessary 90° phase shift is introduced into one of the signals at P.

In the comparators CT the signals are compared with the respective feedback signals from the optical position feedback described above and the difference is used to feed a servo amplifier driving the respective coils 11.

At the same time the X and Y signals are fed to discriminators DR which compare the information with that required. The information on the two key points towards which the spot is moving, in the form of X and Y signals in 5-bit digital form, is converted into analogue form at DAX and DAY. In the discriminators DR, when the spot is moving along a curved sequence of the signal, the direction at any instant (as indicated by the contents of the direction counter D or by the relative rates of change of X and Y) is compared with the desired direction for the end of the segment. In the case of a straight segment the discriminator compares the X and Y co-ordinates of the dot at each instant with the co-ordinates (in analogue form from DAX and DAY) of the next key point. When these coincide, indicating that the point has been reached, the segment counter SG is triggered to initiate the next segment.

The character register CR carries the information for the generation of a single character or symbol. Through the address logic AL it controls a store S containing the detailed information in the form of N 12-bit signals. The output of this store consists of the necessary instructions for setting the radius signal and direction signal, the co-ordinates of the next key point to be reached, the number of segments and key points, and the completion of the character. On completion, all the generators are reset ready for the next symbol. The store also controls the switching on and off of the needle-vibrating signal, where necessary, at discontinuities in the character.

It will be understood that the selection of the successive symbols can be controlled by any of the known information handling techniques, for example by a single manual keyboard operating in real time, or by information stored on tapes or cards.

Instead of vibrating the needle electromagnetically we could use other methods, for example piezo-electric or magnetic-strictive, or even possibly mechanical or pneumatic or hydraulic.

Moreover, although the invention has been described primarily with reference to alphabetical and digital symbols, it will be understood that it may be used to reproduce any other forms of symbol, for example characters in Arabic or Chinese script or musical notes, and even simple pictures.

Although the invention has been described in connection with a system in which successive dots are applied, it could be possible to apply the invention also to a continuously drawn line. In that case the stylus would be rounded. There would still need to be some means of moving the stylus axially, in order to lift it clear of the ribbon or other surface between characters. Also it may be possible to employ two styli side by side, or even more, simultaneously generating two symbols or even, in certain cases, different parts of the same symbol, without departing from the basic idea of the invention.

Although we have referred to typing by impact on a ribbon, the invention may also be applied to ribbonless printing techniques, for example by ink-drop printing, or with ink fed to or through the stylus.

Also, instead of using a mechanical needle or stylus to transfer the ink we may use an electron beam, and deflect it by known beam-deflection techniques (opening the way to very high writing speeds) or even a laser beam deflected by tilting mirrors like a Duddell oscillograph.

In the use of the invention in place of normal typing, it would be possible to store, for a short period, the instructions keyed in by the use of the keyboard, and then, after automatic analysis of the number of characters and spaces, to reproduce the writing a line at a time with automatic justification of the ends of the lines, by appropriate automatic control of the indexing distance between successive characters and between successive words. Even without line justification, the indexing between characters may be variable according to the width of character, as in some known typing systems.

Finally, as indicated earlier, the type head, similar to that of FIGS. 5 and 6, could be in the form of a mobile unit which the user simply holds against the paper or other surface on which the symbols are to be printed. There may be provision for stepping the head along the paper.

We claim

1. A method of reproducing a selected symbol on a writing surface from electrically stored information which is used to control deflection in X and Y directions of a transducer capable of applying ink successively to different locations of said surface whereby to build up said symbol, said method comprising defining a limited number of key datum points within a matrix representing an area within which said symbol is to be formed, said key points lying on fixed points of said matrix, electrically storing information characteristic of said datum points by the co-ordinates thereof, electrically storing information representing a plurality of directions of movement within the plane of said matrix, said directions including at least the X and Y directions and inclined directions intermediate said X and Y directions, electrically storing information representing a plurality of different radii of curvature, including an infinite radius, providing means for controlling movement of said transducer in X and Y directions and selecting items of said stored information and feeding said items successively to said controlling means, said items comprising successively information on a starting key point, on the initial direction and, separately, the radius of curvature of the path to be followed to a second key point, then information of the initial direction and, separately, the radius of curvature of the path to be followed from said second key point, and so forth until completion of the formation of said symbol by said transducer by the resulting succession of smooth lines of various radii of curvature.

2. The method set forth in claim 1 including providing a feedback sequal giving information on instantaneous position of said transducer, detecting the substantial coincidence of said position with that of one of said key points, and using said detection to initiate the feeding to said controlling means of said items on the required path from said one key point to a successive key point.

* * * * *